United States Patent [19]

Yamamoto et al.

[11] Patent Number: 4,542,067

[45] Date of Patent: Sep. 17, 1985

[54] FLAMEPROOFED WATER-REPELLENT WOVEN OR KNITTED SHEET COATED WITH SILICONE CONTAINING FIBROUS POTASSIUM TITANATE

[75] Inventors: Osamu Yamamoto; Hideaki Suda, both of Chiba; Kihachiro Nishiuchi, Tokushima; Misao Izumi, Toyonaka; Noriyoshi Ejima, Tokushima, all of Japan

[73] Assignee: Nitto Boseki Co., Ltd., Fukushima, Japan

[21] Appl. No.: 603,135

[22] Filed: Apr. 23, 1984

[30] Foreign Application Priority Data

Apr. 28, 1983 [JP] Japan ..... 58-75569

[51] Int. Cl.[4] ..... B32B 5/02; B32B 5/06

[52] U.S. Cl. ..... 428/237; 428/242; 428/254; 428/263; 428/264; 428/265; 428/274; 428/447; 428/921

[58] Field of Search ..... 428/237, 242, 254, 263, 428/264, 265, 274, 447, 921

[56] References Cited

U.S. PATENT DOCUMENTS 4,293,611 10/1981 Martin ..... 428/447

*Primary Examiner*—Marion E. McCamish

*Attorney, Agent, or Firm*—Bert J. Lewen; Henry Sternberg

[57] ABSTRACT

The flameproofed water-repellent sheet of the present invention has a construction that a sheet-form base material consisting of a woven or knitted fabric of organic fiber is impregnated with a silicone resin varnish containing at least a fibrous potassium titanate and said silicone resin varnish is dried and cured. Since it has excellent non-flamability and water-repellency and, in addition, a flexibility and a high sewing suitability and a high folding endurance, it can be utilized quite effectively as a tent fabric for large-sized tents, storehouse type tents and the like and as a wall material for pool, and the like.

3 Claims, No Drawings

FLAMEPROOFED WATER-REPELLENT WOVEN OR KNITTED SHEET COATED WITH SILICONE CONTAINING FIBROUS POTASSIUM TITANATE

This invention relates to a flameproofed water-repellent sheet using a woven fabric or knitted fabric of organic fiber as a sheet-form base material. This invention is to provide a nontoxic flameproofed water-repellent sheet which is suitable for sewing, has a flexibility and a high folding endurance, and is satisfactorily usable as a tent fabric for large-sized tents, storehouse type tents and the like, a wall material for pool, and the like.

As the water-repellent sheet utilized mainly in the field of tent fabric, there can be referred to the sheet formed by providing a coating layer of a heat resistant composition on a glass fiber cloth, a sheet formed by providing a coating layer of polyvinyl chloride resin on a knitted or woven fabric of organic fiber, and the like. Although the former is nearly satisfactory in the point that it is water-repellent and flame-retarded simultaneously, it is not suitable for sewing and is poor in folding endurance, so that it cannot be formed into a large-sized tent such as storehouse type tent or entertainment tent. On the other hand, the latter has a fault that it is not flameproofed and is unsatisfactory in water-repellency.

According to this invention, a flameproofed, water-repellent sheet is provided, characterized in that a sheet-form base material consisting of a woven fabric or knitted fabric of orgnic fiber is impregnated with a silicone resin varnish containing at least a fibrous potassium titanate, said silicone resin varnish being dried and cured. The faults of the prior water-repellent sheet having been used as tent fabric can be overcome by using the above construction and a flameproofed water-repellent sheet suitable for sewing, having a high folding endurance, flexibility, and excellence in surface strength can be provided.

Hereunder, the constructional components of the flameproofed water-repellent sheet of this invention will be explained.

(1) Sheet-form Base Material

The sheet-form base material used in the flameproofed water-repellent sheet of this invention is a woven fabric or a knitted fabric of organic fiber such as a cotton yarn, a flax yarn, a ramie yarn, a polyester type synthetic fiber, a polyamide type synthetic fiber, a rayon yarn, a vinylon yarn or the like. It may also be a blended yarn woven fabric and a blended yarn knitted fabric or mixed woven fabric or a mixed knitted fabric obtainable by using two or more members of the above-mentioned organic fibers. Further, according to another embodiment of this invention, a woven fabric or knitted fabric treated with a flame-retardant mentioned later in Paragraph (4) is used for the purpose of giving the sheet a more excellent non-flammability.

(2) Fibrous Potassium Titanate

The fibrous potassium titanate is compounded into a silicone resin varnish and put to use. It gives a sufficient antiflaming characteristic property to the sheet of this invention.

The chemical composition of the fibrous potassium titanate is represented by the following general formula:

$$K_2O \cdot mTiO_2 \cdot nH_2O$$

wherein m represents a positive integer not greater than 8 and n represents zero or a positive integer not greater than 4. In general, it is a whisker having a fiber diameter of 0.1–0.7 μm and a fiber length of 10–50 μm. It is manufactured by calcining process, hydrothermal process or flux process by using titanium oxide and potassium carbonate as the starting materials.

As the fibrous potassium titanate, the above-mentioned material may be used as it is. In order to let it manifest a more excellent reinforcing effect, however, it is preferable to subject the fibrous potassium titanate to a surface treatment using about 0.05–1.0% by weight, based on the fibrous potassium titanate, of a silane coupler such as γ-aminopropyl-triethoxysilane, γ-glycidoxypropyl-trimethoxysilane and the like.

(3) Inorganic Filler

The inorganic filler used in another embodiment of this invention exercises a reinforcing action on the resin layer formed of the silicone resin varnish. Examples include various inorganic substances such as titanium oxide, mica, alumina, talc, powdered glass fiber, fine rock wool, silica powder, clay and the like. When it is desired to give a surface flatness to the resulting sheet, it is usually preferable to use a fine powder having a size of 50 μm or less in order not to deteriorate the flatness of the sheet surface.

(4) Flame-retardant

In still other embodiments of this invention, a sheet having a more excellent antiflaming characteristic is obtained. Although the flame-retardant herein used is not particularly critical, its examples include organic flame-retardants such as phosphoric esters, organic halogen compounds, phosphazene compounds and the like; endothermic decomposition type inorganic compounds including crystal water-releasing type, carbon dioxide-releasing type, decomposition-endotherm type, phase-transition type and the like such as calcined gypsum, alum, calcium carbonate, aluminum hydroxide, hydrotalcite type aluminum silicate and the like; inorganic flame-retardants such as antimony compounds; and the like.

(5) Silicone Resin Varnish

The silicone resin varnish used in the flameproofed water-repellent sheet of this invention contains the fibrous potassium titanate mentioned in Paragraph (2) as an indispensable component. Further, it contains the inorganic filler mentioned in Paragraph (3), the flame-retardant mentioned in Paragraph (4), and the like, if they are necessary.

In the silicone resin varnish used in this invention, the silicone resin present in the varnish gives a sufficient water-repellency to the sheet of this invention. In general, there is used a silicone resin varnish obtained by using an organopolysiloxane type silicone resin such as polydimethylsiloxane type silicone resin, polydiphenylsiloxane type silicone resin, polymethylphenylsiloxane type silicone resin, and modified silicone resins derived therefrom with the other resins such as epoxy-modified silicone resin, polyester-modified silicone resin, fatty acid-modified silicone resin, alkyd-modified silicone resin, amino resin-modified silicone resin and the like, all these organopolysiloxane type silicone resins having at least one substituent such as hydrogen atom, vinyl group, allyl group, aryl group, hydroxyl group, alkoxyl group having 1–4 carbon atoms, amino group, mercapto group and the like, as well as polyacryloxyalkylalkoxysilane type silicone resin, polyvinyl type silicone resin and the like.

In this invention, a varnish obtained by using one member or a mixture of two or more members of the above-mentioned various silicone resins, such as organopolysiloxane type silicone resin, polyacryloxyalkylalkoxysilane type silicone resin, polyvinylsilane type silicone resin and the like in any arbitrary combination can be used. When the self-extinguishability given to the flameproofed water-repellent sheet which is the product of this invention is regarded as important, it is preferable to use an organopolysiloxane type silicone resin in which the polysiloxane component occupies 70% by weight or more of the silicone resin or a polyacryloxyalkylalkoxysilane type or polyvinylsilane type silicone resin in which the copolymerized ethylenic unsaturated monomer occupies 50% by weight or less and preferably 20% by weight or less of the silicone resin. When the self-extinguishability and flexibility given to the flameproofed water-repellent sheet which is the product of this invention are regarded as important, it is preferable to use an unmodified organopolysiloxane type silicone resin.

Since these silicone resins are available in the form of a solid, a plastic paste, a liquid or an emulsion at room temperature, it is needless to say that the silicone resin varnish is obtained by appropriately adding a solvent such as toluene, xylene, trichlene and the like thereto, if it is necessary.

As has been mentioned above, the silicone resin varnish used in this invention is a silicone resin varnish which contains a fibrous potassium titanate as an indispensable component and, in addition to it, inorganic filler, flame-retardant and the like as optional components. Apart from them, curing agents and curing accelerators well known among the specialists skilled in the art, such as metallic salts of carboxylic acids, organotin compounds, titanium chelate compounds, tertiary amine compounds, peroxides, platinum catalysts, colorants and the like may be appropriately incorporated into the silicone resin varnish used in this invention.

The flameproofed water-repellent sheet of this invention is a sheet containing the components mentioned in Paragraphs (1), (2) and (5) as indispensable components. Preferably, the amount of the fibrous potassium titanate incorporated into the silicone resin varnish impregnated into the woven or knitted fabric of organic fiber used as the sheet-form base material should be in the range of about 5–400 parts by weight (fibrous potassium titanate) per 100 parts by weight of the silicone resin, so that the water-repelling action exhibited by the silicone resin is well balanced with the flameproofing action and reinforcing action exhibited by the fibrous potassium titanate. It is also allowable to replace 10–90% by weight of the above-mentioned fibrous potassium titanate with an inorganic filler.

The silicone resin varnish is impregnated into the sheet-form base material consisting of the woven fabric or knitted fabric of organic fiber by an impregnating means such as dipping, spraying, roll coating, reverse roll coating, knife coating and the like so as to give an adherent solid component weight of about 50–500 g/m$^2$, after which the silicone resin in the silicone resin varnish is dried and cured.

As the means for curing the silicone resin varnish impregnated into the sheet-form material consisting of the woven fabric or knitted fabric of organic fiber, curing at room temperature, curing with heating, ultraviolet curing, electron beam curing and the like can be employed. In the case of curing with heating, the treatment is advisably carried out at a temperature of about 150°–200° C. for about 1–30 minutes.

Hereunder, the concrete construction of the flameproofed water-repellent sheet of this invention will be explained with reference to production examples and, at the same time, the physical properties of the flameproofed water-repellent sheets thus obtained will be mentioned.

EXAMPLE 1

A mixed composition consisting of 42.2 parts by weight of a silicone rubber varnish [non-volatile matter: 50%, manufactured by Toshiba Silicone K.K., YR 3270], 25.7 parts by weight of a fibrous potassium titanate [manufactured by Otsuka Kagaku K.K.: Tismo D], 14.7 parts by weight of aluminum hydroxide, 3.4 parts by weight of zinc white, 23.3 parts by weight of xylene and 5 parts by weight of a curing agent [a curing agent for YR 3270] was stirred and homogenized to obtain silicone resin varnish (a) consisting of a nearly uniform dispersion.

The silicone resin varnish (a) thus obtained was impregnated into a sheet-form base material consisting of a woven Vinylon cloth for use as a canvas [KVFR-3A, manufactured by Kuraray K.K., weight 405 g/m$^2$, density 46×35/25.4 mm] by the dipping process so as to give an impregnation weight of 280 g/m$^2$ (in terms of solid content), after which it was dried at 110° C. for 4 minutes and subsequently cured at 180° C. for 6 minutes. Thus, flameproofed water-repellent sheet [i] which is a product of an example of this invention was obtained.

EXAMPLE 2

The silicone resin varnish (a) mentioned in Example 1 was impregnated into one surface of a sheet-form base material consisting of a woven fabric having the same construction as the woven Vinylon cloth for use as a canvas used in Example 1 by the hand coating process so as to give an impregnation weight of 235 g/m$^2$ (in terms of solid content), after which it was dried at 110° C. for 4 minutes and subsequently cured at 180° C. for 6 minutes. Thus, flameproofed water-repellent sheet [ii] which is a product of an example of this invention was obtained.

EXAMPLE 3

A mixed composition consisting of 60 parts by weight of a silicone resin [KR-2706, manufactured by Shin'etsu Kagaku Kogyo K.K.], 2.0 parts of a pigment grade of titanium oxide, 17.6 parts by weight of zinc white, 23.5 parts of mica (G-325), 26.5 parts by weight of a fibrous potassium titanate [Tismo D, manufactured by Otsuka Kagaku Yakuhin K.K.] and 4.0 parts by weight of a curing agent [a curing agent for KR-2706] was stirred and homogenized to obtain silicone resin varnish (b) consisting of a nearly uniform dispersion.

The silicone resin varnish (b) thus obtained was impregnated into a sheet-form base material consisting of a woven cotton cloth for use as a canvas [manufactured by Nitto Boseki K.K., No. 11, weight 300 g/m$^2$, density 44×40/25.4 mm] by the dipping process so as to give an impregnation weight of 230 g/m$^2$ (in terms of solid content), after which it was dried at 110° C. for 4 minutes and subsequently cured at 180° C. for 6 minutes. Thus, a flameproofed water-repellent sheet [iii] which is a product of an example of this invention was obtained.

COMPARATIVE EXAMPLE

A vinyl chloride resin sol [manufactured by Nippon Geon K.K., Geon 121] was impregnated into a sheet-form base material consisting of a woven fabric having the same construction as the woven Vinylon cloth for use as a canvas used in Example 1 by the dipping process so as to give an impregnation weight of 245 g/m$^2$ (in terms of solid content), after which it was dried at 175° C. for 10 minutes. Thus, waterproof sheet [iv] which is a product of the comparative example of this invention was obtained.

Table 1 shows the physical properties of the sheets obtained in the above-mentioned examples and comparative example.

Among the physical properties shown in Table 1, thickness, weight, tensile strength, tear strength and elongation at break were measured according to JIS L-1906, while oxygen index was measured according to JIS K-7201. Water repellency means the contact angle between the sheet and water measured on the resin-coated side of the each sheet by means of Contact Angle Meter CA-D manufactured by Kyowa Kagaku K.K.

As apparent from the values of oxygen index and water-repellency of the sheets shown in Table 1, the sheets which are products of the examples of this invention exhibit far more excellent non-flammability and water-repellency as compared with the product of the comparative example.

TABLE 1

| | Example 1 | Example 2 | Example 3 | Comparative Example |
|---|---|---|---|---|
| Kind of sheet | [i] | [ii] | [iii] | [iv] |
| Thickness (mm) | 0.7 | 0.68 | 0.6 | 0.75 |
| Weight (g/m$^2$) | 680 | 640 | 530 | 650 |

TABLE 1-continued

| | | Example 1 | Example 2 | Example 3 | Comparative Example |
|---|---|---|---|---|---|
| Tensile strength (kgf/25 mm width) | Warp | 51 | 50 | 42 | 60 |
| | Weft | 46 | 45 | 28 | 52 |
| Tear strength (kgf) | Warp | 9.0 | 9.0 | 2.4 | 9.5 |
| | Weft | 8.3 | 9.4 | 3.8 | 8.5 |
| Elongation at break (%) | Warp | 15.8 | 12.3 | 24.3 | 26.7 |
| | Weft | 13.6 | 11.5 | 13.8 | 19.3 |
| Oxygen index | | 33 | 42 | 31 | 21 |
| Water-repellency (degree) | | 109 | 109 | 109 | 87 |

The flameproofed water-repellent sheet of this invention has the construction detailed above, i.e. a construction that a sheet-form base material consisting of a woven or knitted fabric of organic fiber is impregnated with a silicone resin varnish containing at least a fibrous potassium titanate and said silicone resin varnish is dried and cured. Since it has excellent non-flammability and water-repellency and, in addition, a flexibility and a high sewing suitability and a high folding endurance, it can be utilized quite effectively as a tent fabric for large-sized tents, storehouse type tents and the like and as a wall material for pool, and the like.

We claim:

1. A flameproofed water-repellent sheet characterized in that a sheet-form base material consisting of a woven fabric or knitted fabric of an organic fiber selected from cotton, flax, ramie, polyester, polyamide, rayon, nylon or a blended fabric obtainable by using two or more of said fibers is impregnated with a silicone resin varnish containing at least a fibrous potassium titanate, said silicone resin varnish being dried and cured.

2. A flameproofed water-repellent sheet according to claim 1, wherein said silicone resin varnish also contains at least one of an organic filler or a flame-retardant, said flame-retardant being an organic flame-retardant, an inorganic flame-retardant, or both.

3. A flameproofed, water-repellent sheet according to claims 1 or 2 wherein said sheet-form base material is treated with an organic flame-retardant, an inorganic flame-retardant, or both.

* * * * *

UNITED STATES PATENT AND TRADEMARK OFFICE

CERTIFICATE OF CORRECTION

PATENT NO. : 4,542,067

DATED : Sep. 17, 1985

INVENTOR(S) : Osamu Yamamoto, Hideaki Suda, Kihachiro Nishiuchi, Misao Izumi and Noriyoshi Ejima It is certified that error appears in the above-identified patent and that said Letters Patent is hereby corrected as shown below:

On the cover page of the patent, left column, item [73], insert after "Nitto Boseki Co., Ltd., Fukushima, Japan" the following:

--and Otsuka Chemical Co., Ltd., Osaka, Japan--

Signed and Sealed this

Twenty-fifth Day of February 1986

[SEAL]

Attest:

DONALD J. QUIGG

Attesting Officer

Commissioner of Patents and Trademarks